United States Patent [19]

Lajcak

[11] 3,977,711

[45] Aug. 31, 1976

[54] SASH LOCK FOR CLOSURES

[76] Inventor: Stephan Lajcak, 6690 Irving St., Denver, Colo. 80221

[22] Filed: Jan. 12, 1976

[21] Appl. No.: 648,142

[52] U.S. Cl. ..... 292/202; 292/87

[51] Int. Cl.[2] ..... E05C 3/04

[58] Field of Search ..... 292/78, 80, 87–89, 292/202, 216, 241

[56] References Cited

UNITED STATES PATENTS

| | | | |
|---|---|---|---|
| 1,789,605 | 1/1931 | Spencer | 292/216 |
| 3,667,791 | 6/1972 | Kazaoka et al. | 292/216 |
| 3,877,740 | 4/1975 | Carvell et al. | 292/202 |

*Primary Examiner*—Richard E. Moore
*Attorney, Agent, or Firm*—W. Britton Moore

[57] ABSTRACT

This invention relates to a sash lock for swinging and/or sliding enclosure windows and doors and the like. The lock consists of a cam rod adapted to be arranged relative to hingedly swinging or sliding windows and mounted in the window wall opening so as to be engageable with edges thereof. The rod is inset to provide a lip extending longitudinally and spirally thereof whereby it flatly engages a window edge when rotated by an operating lever at one end thereof to lock the window in closed position.

9 Claims, 6 Drawing Figures

SASH LOCK FOR CLOSURES

This invention relates to a sash lock for swinging and/or sliding enclosure windows and doors and the like embodying a cam rod having a longitudinally and spirally extending lip thereon adapted to engage a window edge when rotated to retain the window in locked position.

The principal object of the present invention is to provide a novel sash lock including a cam rod arranged relative to a window edge and having an inset portion with a longitudinally and spirally extending gripping lip thereon for engaging a window edge as the rod is rotated to lock the window in closed position.

Another object is the provision of a sash lock embodying a cam rod arranged parallel to an edge of a window and having a longitudinally extending spirally extending lip thereon and an operating lever to enable the rod to be rotated into clamping engagement relative to the window edge for sealing and locking the window in closed position.

A further object is the provision of a sash lock for a hinged swinging window wherein a cam rod is arranged within a plastic bearing in the window sash so that the rod extends longitudinally of and parallel to an edge of the window whereby a clamping lip extending spirally and longitudinally of the rod is rotated into locking engagement with the window edge for sealing and locking the window.

These and other objects and advantages will be apparent by referring to the accompanying drawings, wherein FIG. 1 is a front elevation of a pair of casement windows hingedly and swingably arranged in a window opening and with sash lock cam rod interposed between the windows;

Figure 1:
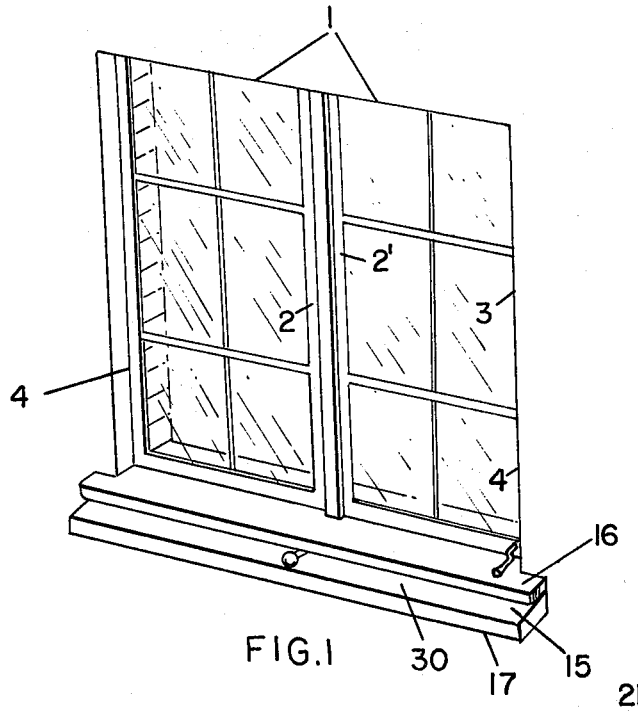
Figure 2:
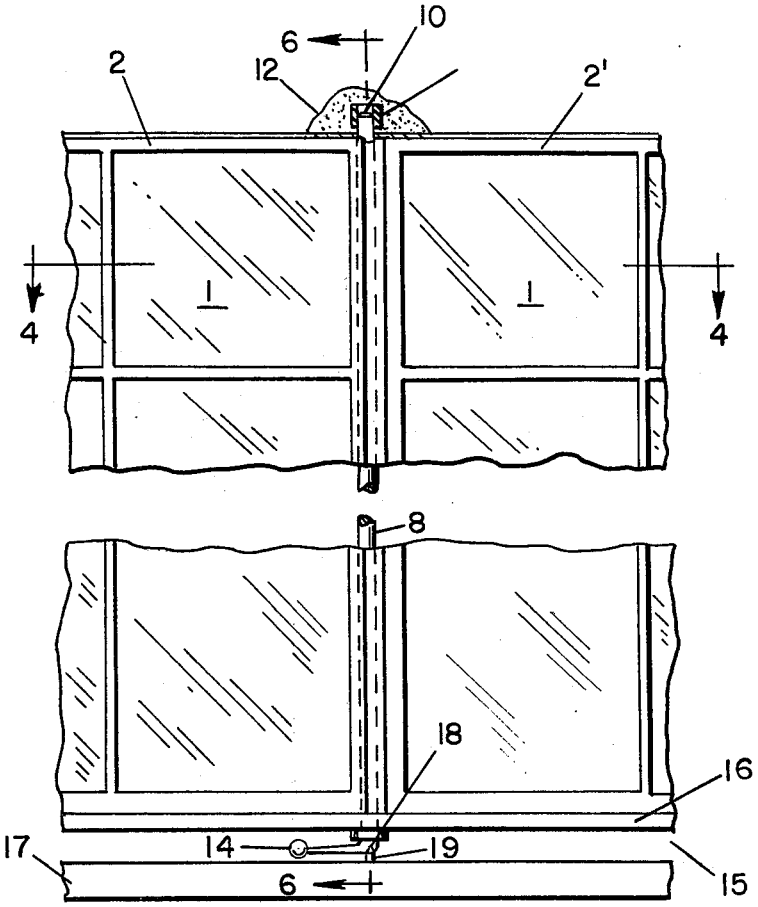
FIG. 2 is a front elevation of a pair of casement windows showing the location of the sash lock cam rod relative to the inner generally abutting edges of the windows.

While this invention may be used for locking sliding and hinged windows and hinged doors and the like, the preferred embodiment will be described as related to a pair of hinged swinging type casement windows, but it is to be understood that by relocating the sash lock cam rod it may be used with other type windows and doors.

Referring more particularly to the drawings, wherein similar reference characters designate like parts throughout the several views, a pair of swinging casement type windows 1 having wood sashes 2 and 2' are arranged within a window opening 3 and suitably hinged along their outer side edges 4 thereon. The sashes may, of course, be constructed of other material, such as, metal or plastic, and an inner side edge 5 of the sash 2 is provided with a concave channel 6 extending from top to bottom thereof and lined with a plastic semi-tubular bearing 7 suitably fixedly secured therein. A cam rod 8 having a curved side wall 9 snugly interfits bearing 7 with the ends of the rod projecting beyond the ends of the bearing. The extended upper end 10 of the cam rod is received in a bearing 11 in upper window frame 12, and the extended lower end 13 thereof is formed with an operating lever 14 which projects laterally of the space 15 between window stool 16 and window sill 17. A recess 18 is provided in the underside of lever 14, in alignment with the axis of the cam rod, and receives therein an upright pin 19 suitably anchored in sill 17 and functioning as a pivot point for the lower end of rod 8. Thus, the upper and lower ends are so supported that rod may be rotated within bearing 7 when lever 14 is manually arcuately moved, as presently will be explained.

Figure 3:
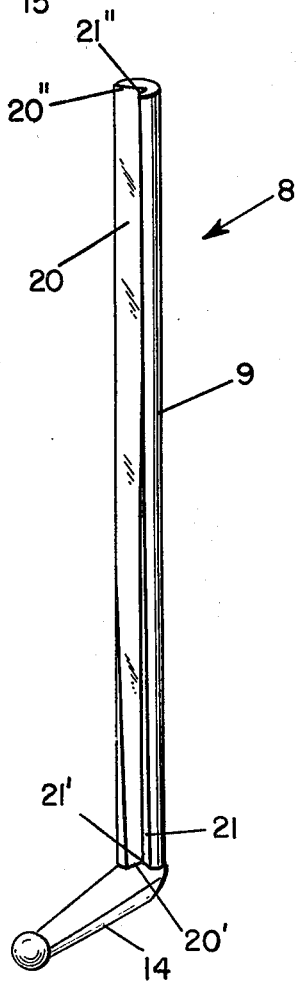
FIG. 3 is a front elevation of a sash lock cam rod.

The cam rod 8 is inset longitudinally to provide a spirally extending flat face 20 terminating in a flat flange 21. As best seen in FIG. 3, face 20 spirals upwardly and rearwardly from its bottom end 20' so that its upper end 20'' is somewhat angularly and rearwardly disposed relative to end 20', which causes the flange 21 to turn in spiral upwardly and forwardly from its lower end 21' and results in the upper end 21'' thereof being disposed forwardly and angularly relative to the lower end. In other words, the rod 8 has a twist or spiral therein extending about its longitudinal axis, for a purpose presently to be described.

Figure 4:
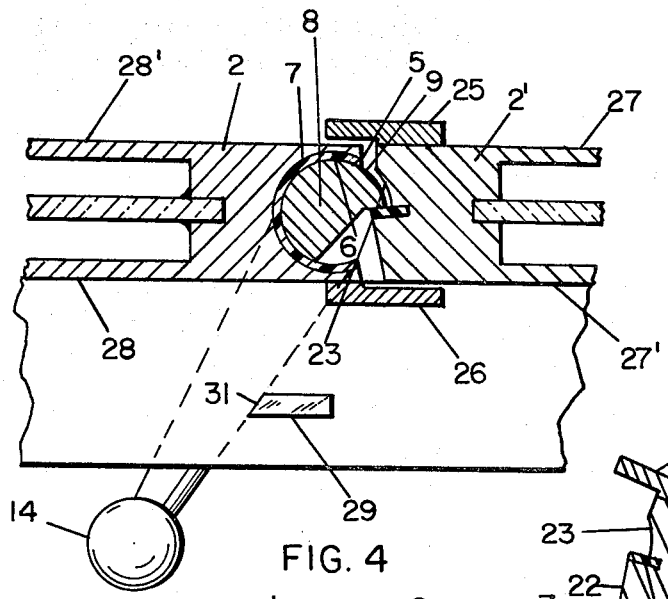
FIG. 4 is a sectional view on the line 4—4 of FIG. 2.

Inner side edge 22 of window sash 2' has an arcuate-shaped channel 23 formed therein throughout its length and which terminates in a flat face 24 so that the curved wall 9 cam rod 8 interfits channel 23 and flange 21 thereon flatly engages face 24 when the cam rod is rotated and twisted clockwise to the closed FIG. 4 position. To insure proper alinement of the sashes in closed position, flat stop plates 25 and 26 are respectively attached to inner face 27 of sash 2' and outer face 28 of sash 2 and project beyond the edges of these faces so that stop 25 flatly engages inner face 28' of sash 2 and stop 26 flatly engages outer face 27' of sash 2' to assist in holding the windows in this closed FIG. 4 position.

Figure 5:
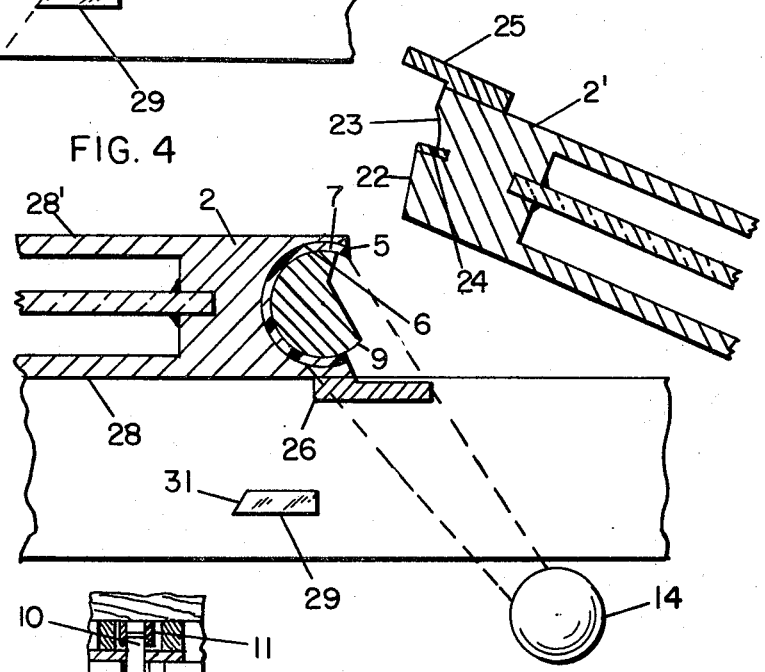
FIG. 5 is a view similar to FIG. 4 with the sash lock cam rod in unlocked position and one of the casement windows is partially open position.
Figure 6:
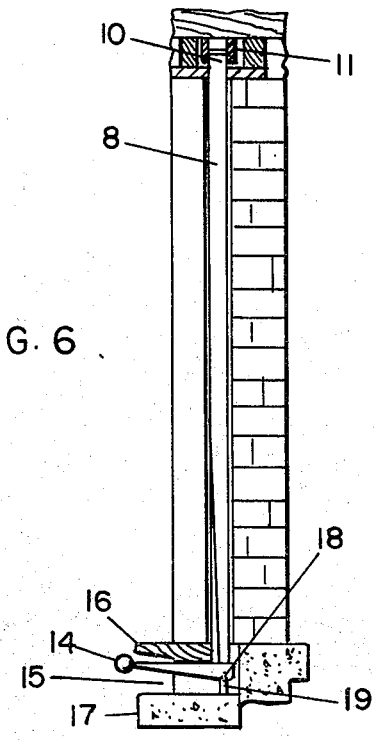
FIG. 6 is a sectional view on the line 6—6 of FIG. 2.

Although the curved wall 9 of cam rod 8 snugly and frictionally engages its bearing 7, which tends to hold the same in position as the rod is twisted therein and relative to its axis, it may be desired to also provide a stop to hold lever 14 at the end of its closing movement. Thus, a beveled stop 29 is suitably attached to top face 30 of window sill 17 whereby when lever 14 extends to the right and cam rod 8 is in the untwisted and unlocked position of FIG. 5, sash 2' may be swung to open position. When sash 2' is moved to closed position, and cam rod 8 is rotated and twisted from FIG. 5 to FIG. 4 positions, lever 14 is moved clockwise and thereby rides up the beveled top face of stop 29 and snaps downwardly when clearing the end 31 thereof so as to be retained in that position by end 31 in an obvious manner. During this rotational movement of lever 14, cam rod 8 will be rotated and twisted with its curved wall 9 rotating relative to bearing 7 and the spirally extending flat face 21 progressively upwardly engaging and pressing against flat flange 24 in channel 23 of sash 2' and successively and continuously forcing flange 24 and its sash 2' into the closed FIG. 4 position. That is, the spiralled face 21 so progressively engages flange 24 from its lower end 21' upwardly to the upper end 21'' thereof that it increasingly and continuously applies pressure thereto causing the cam rod to twist torsionally about its axis until the sash 2' is fully closed. Although the frictional engagement between curved wall 9 and bearing 7 will tend to retain the cam rod in the twisted locked position, it will be additionally locked thereat by stop 29, as previously explained. To unlock the sashes, lever 14 is slightly elevated to clear end 31 of stop 29 and then moved counter clockwise to the right so that spiral face 21 will be moved out of engagement with and pressure is removed from flange 24 until the cam rod assumes its FIG. 5 position, at which time sash 2' may be opened.

When used with a single vertically hinged swinging window, rather than the pair herein shown and described, the concave channel will be arranged in the vertical window frame and will accommodate the semi-tubular bearing and cam rod which will coact with an arcuate-shaped channel in the outer edge of the window. This will also be the case when a cam rod is employed with a door. On the otherhand, in case the window is horizontally hinged, the channel, bearing and cam rod will be arranged in the horizontal window frame, as will be the case with a sliding type window. None of these various embodiments have been illustrated as it is considered that they will be apparent.

It is to be understood that various changes and revisions may be made in the present closure locking cam rod without departing from the scope and spirit of the appended claims.

What is claimed:

1. In a closure arranged for opening movement in a closure opening, said closure and opening being framed, a portion of said closure frame having a channel formed therein and extending therealong, a concave channel provided adjacent said first mentioned channel, a cam rod having a curved side wall seated in and arranged for rotation in said concave channel, said rod being inset longitudinally to provide a flange extending spirally from end to end thereof, an operating lever on one end of said rod, said rod being rotated by said lever to interfit said spiral flange in said first mentioned channel whereby continued rotation of said lever twists said rod and progressively forces said flange into engagement with said channel for locking said closure in closed position.

2. In a closure according to claim 1, wherein a pair of closures are arranged in abutting relationship in said closure opening, said first mentioned channel being formed in a side edge of one of said closure frames, and said concave channel being formed in the adjacent side edge of said other closure frame.

3. In a closure according to claim 2, wherein a semi-tubular bearing is fixedly arranged in said concave channel and is rotationally engaged by the curved wall of said cam rod.

4. In a closure according to claim 2, wherein said closures are windows having sashes therearound, and said first mentioned channel is formed in a side edge of one window sash and said concave channel is formed in an adjacent side edge of said other window sash.

5. In a closure according to claim 4, wherein a bearing is arranged in the window opening frame and one end of said cam rod projects thereinto, and the other end of said cam rod is pivotally connected in said frame.

6. In a closure according to claim 4, wherein the spiral flange on said cam rod is flat, and said first mentioned channel is arcuate-shaped and terminates to a flat wall.

7. In a closure according to claim 6, wherein said first mentioned channel and the flat wall thereof extend longitudinally of said side edge.

8. In a closure according to claim 7, wherein said operating lever projects laterally from an end of said cam rod and is engageable with stop means for retaining said closures in locked closed positions.

9. In a closure according to claim 8, wherein said lever is flexible, said stop means includes a beveled upper face and is spaced from said lever, whereby in arcuate movement of said lever it will ride over said beveled face and snap into locking engagement therewith.

* * * * *